United States Patent [19]

Schumacher

[11] 4,235,248

[45] Nov. 25, 1980

[54] APPARATUS FOR REGULATING THE CONFIGURATION OF THE UPPER SURFACE OF A SUPPLY OF TOBACCO IN A DISTRIBUTOR FOR USE IN CIGARETTE MAKERS OR THE LIKE

[75] Inventor: Peter Schumacher, Hamburg, Fed. Rep. of Germany

[73] Assignee: Hauni-Werke Korber & Co. KG, Hamburg, Fed. Rep. of Germany

[21] Appl. No.: 969,737

[22] Filed: Dec. 15, 1978

[30] Foreign Application Priority Data

Dec. 27, 1977 [DE] Fed. Rep. of Germany ..... 2758358

[51] Int. Cl.[3] ..... A24C 5/39

[52] U.S. Cl. ..... 131/21 A; 131/108; 198/524

[58] Field of Search ..... 131/108, 109 R, 84 C, 131/84 R, 21 D, 21 A, 25; 414/161, 294–296; 222/56, 64; 198/524; 141/198

[56] References Cited

U.S. PATENT DOCUMENTS

| | | | |
|---|---|---|---|
| 1,672,457 | 6/1928 | Granstedt | 131/108 |
| 2,696,606 | 12/1954 | DeLaPomelie | 414/294 X |
| 3,532,099 | 10/1970 | Fuchu et al. | 131/84 C X |
| 3,858,733 | 1/1975 | Morioka et al. | 414/295 X |
| 3,935,970 | 2/1976 | Spaw | 222/56 |
| 4,095,604 | 6/1978 | Labbe | 131/84 R |

FOREIGN PATENT DOCUMENTS

| | | | |
|---|---|---|---|
| 2504902 | 8/1976 | Fed. Rep. of Germany | 131/108 |
| 1273931 | 9/1960 | France | 131/21 A |
| 2231326 | 1/1975 | France | 131/108 |

*Primary Examiner*—Robert W. Michell
*Assistant Examiner*—Jeffrey W. Tayon
*Attorney, Agent, or Firm*—Peter K. Kontler

[57] ABSTRACT

A distributor wherein a belt conveyor transfers batches of tobacco particles from a main magazine into a wide upright duct. The level of different portions of the upper surface of the supply of tobacco in the duct is monitored by several photosensitive detectors which transmit signals for adjustment of a paddle wheel which removes surplus tobacco from the transfer conveyor by brushing off more or less tobacco from different portions of the conveyor, as considered transversely of the direction of movement of the conveyor, in order to maintain the entire upper surface of the tobacco supply in or close to a horizontal plane.

15 Claims, 3 Drawing Figures

APPARATUS FOR REGULATING THE CONFIGURATION OF THE UPPER SURFACE OF A SUPPLY OF TOBACCO IN A DISTRIBUTOR FOR USE IN CIGARETTE MAKERS OR THE LIKE

BACKGROUND OF THE INVENTION

The present invention relates to apparatus for processing tobacco, especially to distributors for use in machines for the making of cigarettes or the like. Still more particularly, the invention relates to improvements in apparatus for regulating the level of the upper surface of a supply of tobacco which is confined in a magazine.

Commonly owned patent application of Ser. No. 834,782 filed Sept. 17, 1977 by Heitmann et al., now U.S. Pat. No. 4,185,644 discloses a distributor for cigarette makers wherein an endless conveyor transfers tobacco from a main magazine into an upright duct and a refuser in the form of a paddle wheel equalizes the batches of tobacco which are transported by the conveyor toward the inlet of the duct. This invention relates to improvements in apparatus of the type disclosed in the application of Heitmann et al.

The aforementioned duct constitutes a relatively small intermediate magazine whose outlet discharges tobacco (or from whose outlet tobacco particles are withdrawn) for conversion into a relatively wide carpet which is thereupon subjected to a classifying action to segregate heavier particles and converted into a rising or descending shower preparatory to the formation of a continuous narrow stream. The stream is trimmed, if necessary, prior to draping into a web of cigarette paper or other suitable wrapping material. The provision of a duct between the main magazine and the carpet forming station is desirable because the volume of tobacco in the duct can be readily maintained within a predetermined range which is best suited for withdrawal of tobacco at a constant rate and in a predictable state. Such withdrawal is a prerequisite for the formation of a homogeneous carpet which, in turn, can be converted into a homogeneous tobacco stream. The duct has been found to contribute significantly to homogenization of the body of tobacco which is treated on its way into the stream forming channel of a cigarette maker or the like. It is important and desirable that the density of tobacco at the outlet of the duct be as constant as possible because this determines the quality of the tobacco stream. To this end, the duct is provided with a level detector which monitors the level of the upper surface of the supply of tobacco in the duct and transmits appropriate signals for adjustment of the mechanism which feeds tobacco into the inlet of the duct. The signals which are transmitted by the level detector can be used to accelerate or decelerate the conveyor which delivers tobacco from the main magazine into the duct in such a way that the rate of feed increases when the upper level, (i.e., the volume) of the tobacco supply sinks and vice versa. Alternatively, and as disclosed in French Pat. No. 1,273,931, the level detector can start or arrest the motor for the tobacco feeding mechanism.

In many instances, the duct is relatively wide as considered in one transverse direction and very narrow as considered in the other transverse direction. Otherwise stated, the duct has relatively wide front and rear walls but narrow side walls which are disposed at the lateral ends of and extend between the front and rear walls. In such ducts, the height of the supply of tobacco often varies, as considered in a direction from one side wall toward the other side wall, i.e., the upper surface of the supply of tobacco in the duct may slope from one side wall toward the other side wall or it may have a peak somewhere between the side walls and two downwardly sloping portions extending from the peak toward the side walls.

The primary reasons for such unequal filling of the duct are the size, shape, weight, moisture content and other characteristics of tobacco which is drawn from the main magazine. The body of tobacco in the main magazine is not a homogeneous mass; it comprises particles of dust, relatively large fragments of ribs, and clumps of interlaced shreds. The conveyor (e.g., an endless carded belt) which removes tobacco from the main magazine is incapable of withdrawing tobacco at a uniform rate, i.e., the quantity of tobacco along one marginal portion of such conveyor often exceeds the quantity of tobacco which is adjacent to the other marginal portion. Consequently, certain portions of the conveyor entrain large batches of tobacco whereas other portions entrain much smaller quantities. Furthermore, batches of tobacco which contain large quantities of dust or so-called shorts are likely to form dense parts of the supply of tobacco in the duct. The presence of accumulations of tobacco dust in the main magazine is due to the fact that dust is collected in several areas of a cigarette maker and the accumulated dust is segregated from the conveying medium (normally air flowing to a suction generating device) and returned into the main magazine. Still further, unequal distribution of tobacco in the dust (so that the upper surface of tobacco supply slopes toward the one or the other side wall of the duct) can be caused by improper adjustment of paddles on the paddle wheel or a like refuser which is used to remove the surplus from the transfer conveyor.

OBJECTS AND SUMMARY OF THE INVENTION

An object of the invention is to provide a novel and improved tobacco processing apparatus which is constructed and assembled in such a way that the upper surface of the tobacco supply from which tobacco particles are withdrawn for conversion into a continuous tobacco stream or carpet fluctuates very little or not at all, and wherein all or nearly all portions of such upper surface are disposed at or close to a desired level.

Another object of the invention is to provide a tobacco distributor, especially for use in cigarette makers, wherein all or nearly all portions of an upright or substantially upright tobacco storing duct are filled to the same level.

A further object of the invention is to provide an apparatus of the above outlined character with novel and improved means for regulating the level of various portions of the upper surface of a tobacco supply in the duct.

An additional object of the invention is to provide the apparatus with novel and improved means for adjusting the rate of tobacco delivery to the duct in automatic response to detected deviations of the level of certain portions of the upper surface of tobacco supply from a desired level.

Another object of the invention is to provide a distributor wherein the upper surface of the tobacco supply in the duct which precedes the carpet forming devices is horizontal or nearly horizontal to thus guarantee or at least greatly increase the likelihood of satisfactory homogeneousness of the supply.

An ancillary object of the invention is to provide a novel system of level detectors for use in an apparatus of the above outlined character.

An additional object of the invention is to provide novel and improved means for evaluating the signals which are transmitted by the aforementioned level detectors.

A feature of the invention resides in the provision of a tobacco processing apparatus which may constitute the distributor of a cigarette maker. The apparatus comprises a substantially upright magazine (e.g., a vertical duct) which serves to store a supply of tobacco particles and has an inlet, an outlet at a level below the inlet, a front wall, a rear wall opposite the front wall and two spaced-apart side walls between the front and rear walls, and means for feeding tobacco particles to the magazine by way of the inlet. The feeding means is adjustable to feed varying quantities of tobacco particles, as considered in a direction from one of the side walls toward the other side wall. The feeding means may comprise an endless belt conveyor having an upwardly moving reach which draws tobacco from a main magazine and has a discharge end above the inlet to permit the particles of tobacco to enter the first mentioned magazine by gravity feed, and an adjustable refuser (preferably a driven paddle wheel) which is adjacent to the upwardly moving reach, preferably close to the discharge end of the conveyor, and has one or more portions movable nearer to or further away from the tobacco-entraining reach. The apparatus further comprises means for monitoring the level of the upper surface of the supply of tobacco particles in the first mentioned magazine; such monitoring means comprises at least two detectors (e.g., sets of reflection type photocells) which are spaced apart from each other, as considered in the aforementioned direction from the one toward the other side wall, and serve to transmit first signals denoting the levels of the corresponding portions of the upper surface of the supply. Still further, the apparatus comprises means for evaluating the first signals, including means for generating second signals denoting the difference between the levels of the monitored portions of the upper surface of the supply, and means for adjusting the feeding means in response to the second signals so as to reduce such difference, preferably to maintain the upper surface of the supply in or close to a substanatially horizontal plane.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
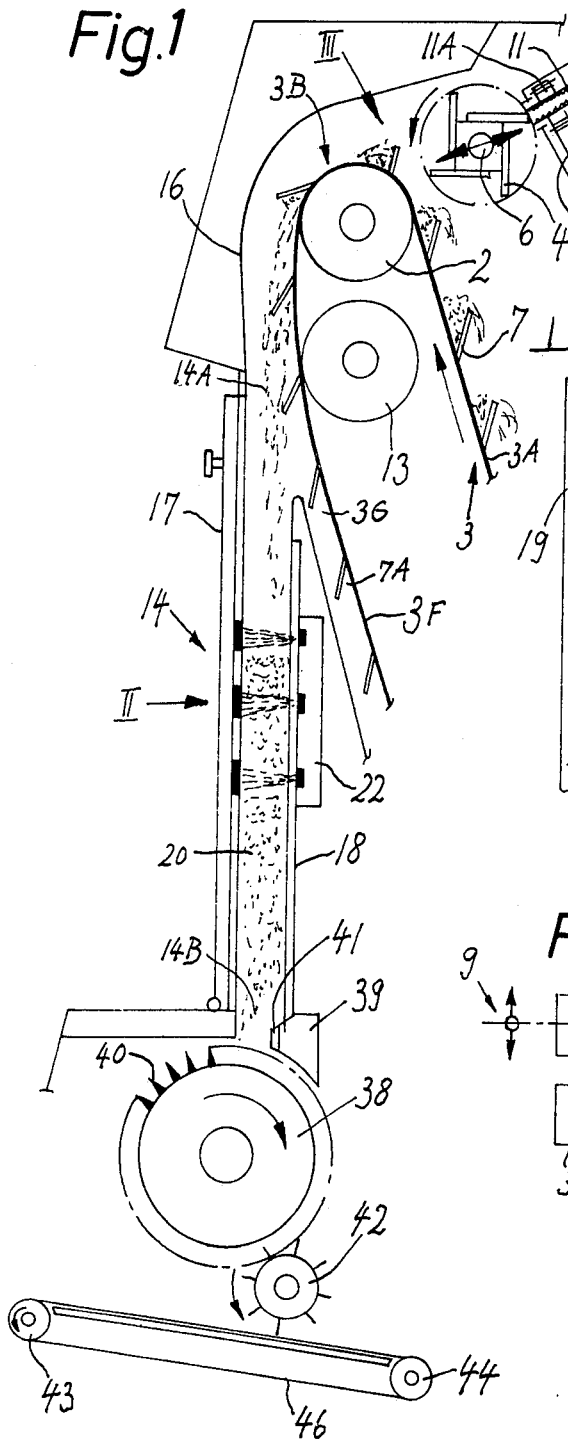
FIG. 1 is a partly diagrammatic and partly schematic vertical sectional view of an apparatus which embodies one form of the invention.

The structure which is shown in FIG. 1 forms part of a distributor for use in a cigarette maker. Many parts of the illustrated structure are similar to or identical with those which are described and shown in the aforementioned copending application of Heitmann et al. A relatively large supply of tobacco is stored in a main magazine or hopper 1 from which batches of tobacco particles are withdrawn by the upwardly moving reach 3A of an endless belt conveyor 3 trained over several pulleys including an upper pulley 2 and a lower pulley, not shown, which latter is driven by a variable-speed motor in a manner as disclosed in the application of Heitmann et al. The belt 3 has transversely extending entraining elements 7 which are inclined upwardly and outwardly during travel with the reach 3A to advance batches of tobacco particles toward the discharge end 3B of the belt. It will be noted that the reach 3A constitutes a mobile side wall of the main magazine 1. The belt 3 forms part of a tobacco feeding unit which further includes a refuser here shown as a rotary paddle wheel 6 having equally spaced paddles 4 made of leather or other flexible strip material to equalize the batches in the pockets 7A between the reach 3A and the entraining elements 7. In accordance with a feature of the invention, the paddle wheel 6 (which extends transversely of the reach 3A and is closely adjacent to the discharge end 3B of the belt 3) is adjustable with respect to the reach 3A so as to increase or reduce the distance between at least one of its portions and the belt 3. The paddle wheel 6 is driven by a suitably tensioned toothed belt or chain which derives motion from one of the pulleys for the belt 3.

Figure 3:
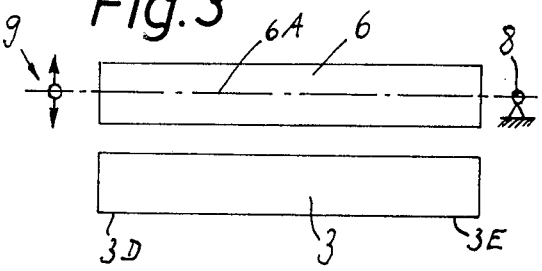
FIG. 3 is a view substantially as seen in the direction of arrow III of FIG. 1.

As shown in FIG. 3, one end portion of the shaft 6A (denoted by a phantom line) of the paddle wheel 6 is mounted in a pivot member 8 and the other end portion of the shaft 6A is movable toward and away from the adjacent marginal portion 3D of the belt 3. Thus, the width of the gap between the components 3 and 6 of the feeding unit can be increased or reduced in such a way that the width of the gap is constant, that the width of the gap increases in a direction from the pivot 8 toward the other end portion of the shaft 6A, or that the width of the gap decreases counter to the just mentioned direction.

The means 9 for adjusting the paddle wheel 6 relative to the belt 3 and for thereby regulating the rate at which the belt transports tobacco, as considered in a direction from the marginal portion 3D toward the marginal portion 3E of the belt 3 (or vice versa) comprises a feed screw 11 which is articulately connected with the left-hand end portion of the shaft 6A (as viewed in FIG. 3), means (not shown) for holding the feed screw 11 against rotation (such means may constitute the joint which articulately connects the feed screw 11 to the shaft 6A), an internally threaded nut or gear 11A which meshes with the feed screw 11 and with a further gear 11B, and a reversible electric or fluid-operated motor 12 which can rotate the gear 11B in a clockwise or counterclockwise direction.

The left-hand reach 3F of the belt 3 contacts a guide roller 13 which is disposed below the pulley 2 and causes the uppermost portion of the reach 3F to travel substantially vertically downwardly so that the pockets 7A between the belt 3 and successive entraining elements 7 dump their contents into the inlet 14A of an upright second magazine or duct 14. Empty pockets 7A thereupon advance in a channel 3G toward the lower pulley for the belt 3 and reenter the main magazine 1 to be refilled with tobacco. A shroud 16 whose curvature matches the curvature of the discharge end 3B of the belt 3 insures that all particles of tobacco enter the inlet 14A. The lower end portion of the duct 14 defines an outlet 14B from which homogenized tobacco of the supply 20 in the duct 14 is withdrawn by a toothed drum 38.

Figure 2:
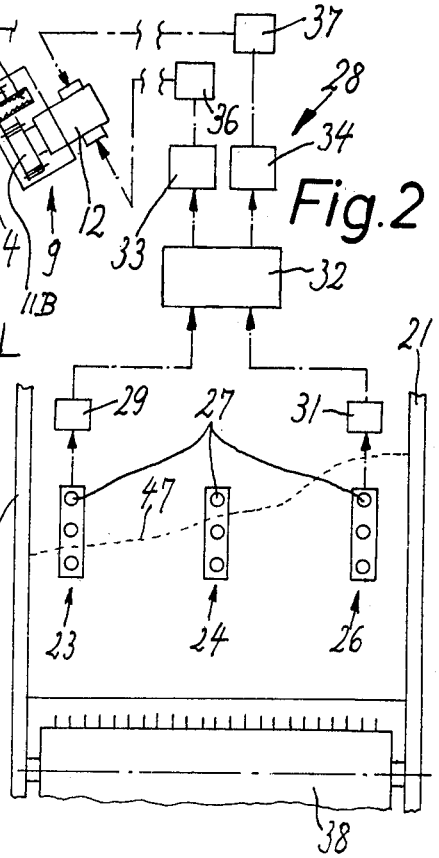
FIG. 2 is a view as seen in the direction of arrow II in FIG. 1, with the front wall of the duct omitted.

The duct 14 comprises a substantially flat vertical front wall 17 which constitutes a downward extension of the lower end portion of the shroud 16, a substantially flat vertical rear wall 18 which is parallel or nearly parallel to the front wall 17, and two narrow end walls 19 and 21 (see FIG. 2) which extend between the respective marginal portions of the walls 17, 18. It will be noted that the width of the duct 14 (as measured in a horizontal plane at right angles to the plane of FIG. 1) is several times the distance between the walls 17 and 18, i.e., the duct is narrow as measured in the plane of FIG. 1. The width of the duct 14 (i.e., the distance between the side walls 19 and 21) preferably equals or slightly exceeds the width of the belt 3.

The rear wall 18 of the duct 14 supports a monitoring device 22 including several (preferably three) detectors 23, 24, 26 which are mounted at the same level and are spaced apart from each other, as considered in the direction from the side wall 19 toward the side wall 21. The detector 23 is adjacent to the side wall 19, the detector 26 is adjacent to the side wall 21, and the detector 24 is located substantially midway between the detectors 23, 26. Each detector comprises three reflection type photocells 27 which are mounted one above the other. In a manner known per se, the output elements of the photocells 27 transmit signals to a control circuit for the aforementioned motor which drives the lower pulley for the belt 3. Reference may be had to commonly owned U.S. Pat. No. 4,011,966 granted Mar. 15, 1977 to Günter Wahle et al. or to the commonly owned copending application Ser. No. 795,559 filed May 10, 1977 by Heinz-Christen Lorenzen. The just mentioned operative connection between the photocells 27 and the motor for the lower pulley of the belt 3 forms no part of the present invention.

In accordance with a feature of the invention, the (first) signals which are transmitted by the photocells 27 of the two outer detectors 23 and 26 are utilized to actuate the motor 12 of the adjusting means 9 by way of an evaluating circuit 28. The connection is such that the motor 12 causes the left-hand end portion of the paddle wheel 6 (as viewed in FIG. 3) to move toward the belt 3 when the adjacent portion of the upper surface 47 (see FIG. 2) of the supply 20 in the duct 14 is located at a higher level than the upper surface portion which is adjacent to the end wall 21, and vice versa.

The evaluating circuit 28 comprises two summing or totalizing amplifiers 29 and 31 which respectively receive signals from the photocells 27 of the detectors 23, 26 and transmit corresponding signals to a signal comparing means 32 (e.g., a differentiating circuit) which has outputs for transmission of positive and negative signals to threshold circuits 33 and 34. These threshold circuits respectively transmit second signals (with positive and negative signs) to the control circuits 36, 37 which can respectively start the motor 12 to rotate the gear 11B in a clockwise and counterclockwise direction, i.e., to cause the spindle 11 to move axially toward or away from the adjacent marginal portion 3D of the belt 3.

The output of the summing amplifier 29 transmits a signal whose intensity denotes the number of exposed photocells 27 in the detector 23, and the intensity of the signal at the output of the amplifier 31 denotes the number of those photocells 27 (if any) in the detector 26 which are exposed or surrounded by tobacco. One output of the differentiating circuit 32 transmits a signal when the intensity of signal at the output of the amplifier 29 exceeds the intensity of signal at the output of the amplifier 31 plus one, and the other output of the circuit 32 transmits a signal when the situation is just the opposite. The output of the threshold circuit 33 transmits the corresponding signal (intensity of signal transmitted by amplifier 29 exceeds the intensity of signal from amplifier 31 plus one) to the control circuit 36 which starts the motor 12 in a direction to move the left-hand end portion of the paddle wheel 6 (as seen in FIG. 3) away from the belt 3 whereby the corresponding end portions of the paddles 4 remove less tobacco from successive batches and the level of the left-hand portion of the upper surface 47 of the tobacco supply 20 in the duct 14 rises. Analogously, the threshold circuit 34 transmits a signal to the control circuit 37 to cause the left-hand end portion of the paddle wheel 6 to move nearer to the belt 3 when the signal at the right-hand output of the differentiating circuit 32 indicates that the number of exposed photocells 27 in the detector 26 is higher than in the left-hand detector 23.

The outlet 14B of the duct 14 is located at the one o'clock position of the tobacco receiving toothed drum 38, which latter is driven by the main prime mover of the cigarette maker through the medium of an infinitely variable speed transmission, not shown. Reference may be had to the aforementioned application of Heitmann et al. The drum 38 is driven in a clockwise direction, as viewed in FIG. 1, and cooperates with a reciprocable barrier 39 which is mounted at one side of the outlet 14B and has homogenizing projections 41. The barrier 39 is movable back and forth in the axial direction of the drum 38 in a manner as disclosed, for example, in the commonly owned U.S. Pat. No. 3,996,944 granted Dec. 14, 1976 to Alfred Hinzmann. The disclosure of this patent is incorporated herein by reference. The barrier 39 not only homogenizes the supply of tobacco in the lower part of the duct 14 but also insures that the spaces between the teeth 40 of the drum 38 are uniformly filled with tobacco particles during travel of such teeth past the outlet 14B. That side of the barrier 39 which is adjacent to the path of movement of the teeth 40 is preferably profiled in a manner as disclosed in the aforementioned patent to Hinzmann and in the aforementioned application of Heitmann et al.

A rapidly rotating picker roller 42 is mounted at the five o'clock position of the drum 38 and serves to expel the particles of tobacco from the spaces between the teeth 40. Such particles are propelled onto the upper reach of a wide endless band or apron 46 which is trained over pulleys 43, 44 and serves to accumulate a wide carpet or sliver of tobacco particles. The particles of the sliver on the apron 46 are thereupon subjected to a classifying action to segregate acceptable shreds from heavier particles (such as fragments of metal, sand, fragments of rock, fragments of tobacco ribs, birds' eyes or the like), and the satisfactory shreds are showered into an upwardly or downwardly extending channel to be intercepted by a narrow tobacco stream forming belt of the type customarily used in cigarette makers (see the application of Heitmann et al.). The picker roller 42 is driven at a constant speed in a counterclockwise direction, as viewed in FIG. 1. The apron 46 is also driven at a constant speed. The outer side of the apron 46 is preferably profiled and coated with rubber or other suitable friction-generating material to insure that the particles which are propelled by the picker roller 42 are caused to advance with the upper reach of the apron 46 without any or with negligible slippage.

The operation of the apparatus is as follows:

The pockets 7A which are defined by the upwardly moving reach 3A of the belt 3 and the respective entraining elements 7 remove batches of tobacco particles from the supply in the main magazine 1 and transport such batches toward the discharge end 3B to thereupon dump the batches into the duct 14 via inlet 14A. The batches which are removed by the pockets 7A are relatively small, and the volume of the duct 14 is preferably a small fraction of the volume of the main magazine 1. The paddles 4 of the rotating wheel 6 remove the surplus from the batches in the pockets 7A which travel with the upwardly moving reach 3A so that, in the neutral position of the paddle wheel 6 and assuming that the density of tobacco in the magazine 1 is constant or nearly constant, each equalized batch contains identical quantities of tobacco particles per unit length thereof (as considered at right angles to the plane of FIG. 1). The paddles 4 return removed tobacco particles directly into the supply of tobacco in the main magazine 1. Under normal operating conditions, the paddle wheel 6 will assume its neutral position in which (as shown in FIG. 3) the width of the gap between this wheel and the reach 3A of the belt 3 is constant all the way from the one to the other marginal portion of the reach 3A.

The guide roller 13 causes successive pockets 7A which advance beyond the discharge end 3B to move vertically downwardly to thus insure that the batches are caused to descend into the duct 14 by gravity. The entraining elements 7 thereupon enter the channel 3G and return into the magazine 1. Tobacco particles which impinge upon the internal surface of the shroud 16 are caused to enter the median portion of the duct 14, i.e., substantially midway between the front wall 17 and the rear wall 18.

The unit 22 monitors the configuration of the upper surface 47 of the supply 20 of tobacco particles in the duct 14. As mentioned above, the detectors 23, 24 and 26 of the unit 22 (or at least the photocells 27 of one of these detectors) transmit signals which are used to regulate the speed of the motor which drives the lower pulley of the belt 3. This insures that the average height of the supply 20 in the duct 14 is substantially constant. For example, the speed of the just mentioned motor can be varied as a function of the number of exposed photocells 27 in the median detector 24 to increase the speed of the motor when the number of exposed photocells 27 in the detector 24 increases and vice versa. The motor can receive signals from a three-stage amplifier of the type disclosed in the aforementioned copending application of Lorenzen. The cells 27 of the detectors 23, 24, 26 transmit signals when they are exposed, i.e., when the corresponding portions of the upper surface 47 of the supply 20 are located therebelow.

At the same time, the cells 27 of the two outer detectors 23, 26 transmit (or do not transmit) signals to the amplifiers 29 and 31. As explained above, such signals are used to adjust the configuration of the upper surface 47 so as to insure that the surface 47 is normally horizontal or nearly horizontal.

FIG. 3 shows that the adjusting means 9 is adjacent to the marginal portion 3D of the belt 3, i.e., such adjusting means is adjacent to the detector 23. When all three cells 27 of the detector 23 are exposed (thus, each of these cells transmits a signal to the associated amplifier 29 of the evaluating circuit 28), and all three cells 27 of the detector 26 are buried in the supply 20 of tobacco particles (i.e., when the cells 27 of the detector 26 cannot transmit signals to the amplifier 31), the differentiating circuit 32 determines the difference between the sum of signals which are transmitted by the detector 23 and the sum of signals (zero) transmitted by the detector 26. The difference (three) is positive and, therefore, the threshold circuit 33 (which is activated when the difference is positive plus one) transmits a signal to the corresponding control circuit 36. The circuit 36 starts the motor 12 in a direction to rotate the feed screw 11 in a sense to move the left-hand end portion of the paddle wheel 6 (as viewed in FIG. 3) away from the marginal portion 3D of the belt 3, i.e., the paddles 4 remove less tobacco from the adjacent portions of the pockets 7A and the portion of the supply 20 which is adjacent to the end wall 19 receives more tobacco than before. This results in gradual rise of the corresponding portion of the upper surface 47, i.e., the configuration of the upper surface 47 begins to more closely resemble a horizontal line.

If the supply 20 in the duct 14 covers the lowermost cell 27 of the detector 23 and only the uppermost cell 27 of the detector 26 remains exposed, the circuit 32 again determines a positive difference (because the two upper cells 27 of the detector 23 are exposed). However, since the threshold circuit 33 transmits a signal only when the difference is a positive difference plus one, the circuit 36 does not receive a (second) signal and the axial position of the feed screw 11 remains unchanged. Thus, the upper surface 47 continues to slope downwardly in a direction from the end wall 21 toward the end wall 19; however, the inclination is not sufficient to warrant an adjustment of the paddle wheel 6. The situation is analogous when two cells 27 of the detector 26 are exposed while the supply 20 extends to a level between the median and upper cells 27 of the detector 23. The threshold circuit 34 does not transmit a (second) signal to the associated control circuit 37 and the position of the paddle wheel 6 with respect to the reach 3A of the belt 3 remains unchanged.

When all three cells 27 of the detector 23 are buried in the supply 20 while the three cells 27 of the detector 26 remain exposed, the (negative) difference between the signals transmitted by the detectors 23 and 26 is $-3$. This causes the threshold circuit 34 to transmit a signal to the control circuit 37 which starts the motor 12 in a direction to move the left-hand end portion of the paddle wheel 6 (as viewed in FIG. 3) toward the marginal portion 3D of the belt 3. The left-hand portion of the paddle wheel 6 removes more tobacco than before and the level of the left-hand portion of the upper surface 47 begins to descend.

The motor 12 is not started when the number of exposed cells 27 in the detector 23 equals the number of exposed cells 27 in the detector 26. This denotes that the upper surface 47 of the supply 20 in the duct 14 is substantially horizontal.

The reciprocating barrier 39 at the outlet 14B of the duct 14 insures uniform filling of spaces between the teeth 40 of the drum 38. Such function is performed by the projections 41 which move back and forth toward and away from the observer of FIG. 1. The projections 41 further insure that the particles of tobacco at the lower end of the supply 20 are in constant motion which promotes the downward movement of the supply 20 into the range of the teeth 40. The picker roller 42 propels the particles of tobacco from the spaces between the teeth 40 onto the apron 46. The latter transports the thus obtained carpet toward the classifying station.

It is also within the purview of the invention to replace the illustrated feeding unit 3, 6 with a modified feeding unit which does not employ a paddle wheel. Instead, the belt 3 is replaced with a series of discrete parallel belts each of which can be driven at a different speed and each of which can transfer tobacco from the main magazine 1 into the duct 14 independently of the other discrete belts. Signals which are transmitted by the detectors 23 and 26 are then utilized to change the speed of selected discrete belts and to thus regulate the rate of tobacco delivery to the duct 14, as considered in a direction from the end wall 19 toward the end wall 21. The feeding unit which is shown in the drawing is preferred at this time because it is simpler and its conveyor (3) need not receive motion from several prime movers.

It is further within the purview of the invention to utilize a feeding unit wherein the one-piece paddle wheel 6 of FIGS. 1 and 3 is replaced by a row of discrete paddle wheels which can be moved toward and away from the belt 3 independently of each other. Thus, signals which are transmitted by the left-hand output of the differentiating circuit 32 could be utilized to change the position of a paddle wheel or paddle wheels which are adjacent to the marginal portion 3D of the belt, and signals transmitted by the right-hand output of the circuit 32 could be used to change the position of the paddle wheel or paddle wheels nearer to the marginal portion 3E. Such feeding unit would also enable the apparatus to regulate the configuration of the upper surface of the tobacco supply in the duct 14. The illustrated feeding unit is preferred, at this time, over the just described modification because it can utilize a one-piece paddle wheel and because a single adjusting mechanism suffices to regulate the rate of tobacco delivery along the full width of the duct (as considered in a direction from the end wall 19 toward the end wall 21 or vice versa).

It is further clear that the monitoring means 22 could utilize only two detectors (23, 24, or 23, 26 or 24, 26) or four or more detectors. The use of three or more detectors for regulation of the configuration of the upper surface 47 would entail appropriate modifications of the evaluating circuit 28. It has been found that two detectors (23 and 26) are sufficient to effect appropriate adjustments of the configuration of the surface 47, especially if such detectors are mounted at a considerable distance from each other (i.e., close to the respective end walls 19 and 21). This insures that the detectors monitor those portions of the surface 47 which are most likely (or especially likely) to be disposed at widely different levels.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Tobacco processing apparatus, particularly a distributor for use in cigarette making machines or the like, comprising a substantially upright magazine arranged to store a supply of tobacco and having an inlet and an outlet below said inlet, said magazine comprising a front wall, a rear wall and two spaced-apart side walls, means for feeding tobacco to said magazine via said inlet, said feeding means being adjustable to feed varying quantities of tobacco, as considered in a direction from one of said side walls toward the other of said side walls; means for receiving tobacco from said outlet; means for simultaneously monitoring different portions of the upper surface of the supply of tobacco between the walls of said magazine, including at least two level detectors spaced apart from each other, as considered in said direction, and arranged to transmit first signals denoting the vertical levels of the corresponding portions of the upper surface of the supply of tobacco between the walls of said magazine; means for evaluating said first signals including means for generating second signals denoting the difference between the vertical levels of said portions of said upper surface; and means for adjusting said feeding means in response to said second signals so as to reduce said difference.

2. Apparatus as defined in claim 1, wherein the distance between said side walls greatly exceeds the distance between said front and rear walls.

3. Apparatus as defined in claim 1, wherein said feeding means comprises a conveyor arranged to transport tobacco toward said inlet and adjustable refuser means adjacent to said conveyor, said adjusting means comprising means for changing the position of said refuser means with respect to said conveyor, as considered in said direction.

4. Apparatus as defined in claim 3, wherein said refuser means is movable between a plurality of positions in each of which at least one portion thereof is located at a different distance from said conveyor.

5. Apparatus as defined in claim 4, wherein said refuser means comprises a rotary paddle wheel extending transversely of said conveyor, as considered in said direction, and having a first end portion and a second end portion, said position changing means including means for moving one of said end portions toward or away from said conveyor.

6. Apparatus as defined in claim 5, wherein said conveyor includes an endless conveyor having an upwardly moving tobacco transporting reach and a discharge end at the upper end of said reach, said paddle wheel being adjacent to said reach of said endless conveyor.

7. Apparatus as defined in claim 6, wherein said upper end of said reach is arranged to discharge tobacco into said inlet by gravity feed and said paddle wheel is adjacent to said upper end.

8. Apparatus as defined in claim 5, further comprising pivot means for the other end portion of said paddle wheel.

9. Apparatus as defined in claim 1, wherein said detectors include a first detector adjacent to one of said end walls and a second detector adjacent to the other of said end walls.

10. Apparatus as defined in claim 1, wherein each of said detectors comprises a plurality of photocells disposed one above the other.

11. Apparatus as defined in claim 10, wherein each of said photocells is a reflection type photocell.

12. Apparatus as defined in claim 10, wherein each of said detectors comprises three photocells.

13. Apparatus as defined in claim 1, wherein said evaluating means comprises means for comparing the characteristics of first signals which are transmitted by said detectors and for generating second signals whose sign is respectively positive and negative when the intensity of first signals transmitted by one of said detectors exceeds the intensity of first signals transmitted by the other of said detectors and vice versa.

14. Apparatus as defined in claim 13, wherein said adjusting means comprises a feed screw rotatable in clockwise and counterclockwise directions and reversible motor means for respectively rotating said feed screw clockwise and counterclockwise in response to said positive and negative second signals.

15. Apparatus as defined in claim 1, wherein said magazine is a vertical duct and said front and rear walls thereof are substantially flat, the distance between said side walls being a multiple of the distance between said front and rear walls and all of said detectors being disposed at a predetermined level.

* * * * *